United States Patent [19]

Clark, Jr.

[11] Patent Number: 4,823,979

[45] Date of Patent: Apr. 25, 1989

[54] TRASH CONTAINER

[76] Inventor: Ceffus Clark, Jr., 4088 Archer Dr., Memphis, Tenn. 38109

[21] Appl. No.: 229,716

[22] Filed: Aug. 8, 1988

[51] Int. Cl.[4] ..... B65D 25/16

[52] U.S. Cl. ..... 220/407; 220/1 T

[58] Field of Search ..... 220/1 T, 407

[56] References Cited

U.S. PATENT DOCUMENTS

| | | | |
|---|---|---|---|
| 3,185,339 | 5/1965 | Fleming | 220/1 T X |
| 3,451,453 | 6/1969 | Heck | 220/1 T X |
| 3,502,242 | 3/1970 | DuBois | 220/1 T |
| 3,760,975 | 9/1973 | Nilsson | 220/407 X |
| 4,319,694 | 3/1982 | Nehrbass et al. | 220/1 T X |
| 4,349,123 | 9/1982 | Yang | 220/1 T X |
| 4,721,226 | 1/1988 | Yurko | 220/1 T X |

*Primary Examiner*—Steven M. Pollard

*Attorney, Agent, or Firm*—Walker & McKenzie

[57] ABSTRACT

A trash container for use in combination with a roll of trash bags. The trash container includes a main body compartment having an open interior and having an open mouth communicating with the interior and through which trash may be inserted; and holding structure for holding the roll of trash bags adjacent the main body compartment. The main body compartment has a slot therethrough to allow the free end of the roll of trash bags held within the holding structure to extend therethrough into the interior of the main body compartment.

3 Claims, 1 Drawing Sheet

FIG. 1
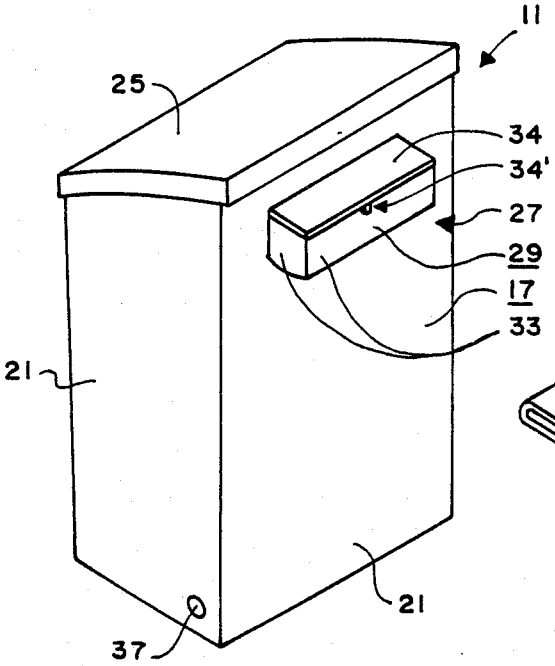
FIG. 2
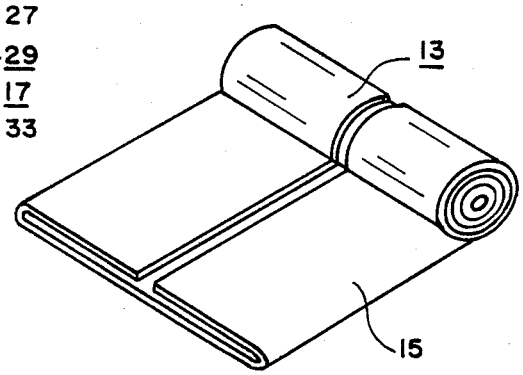
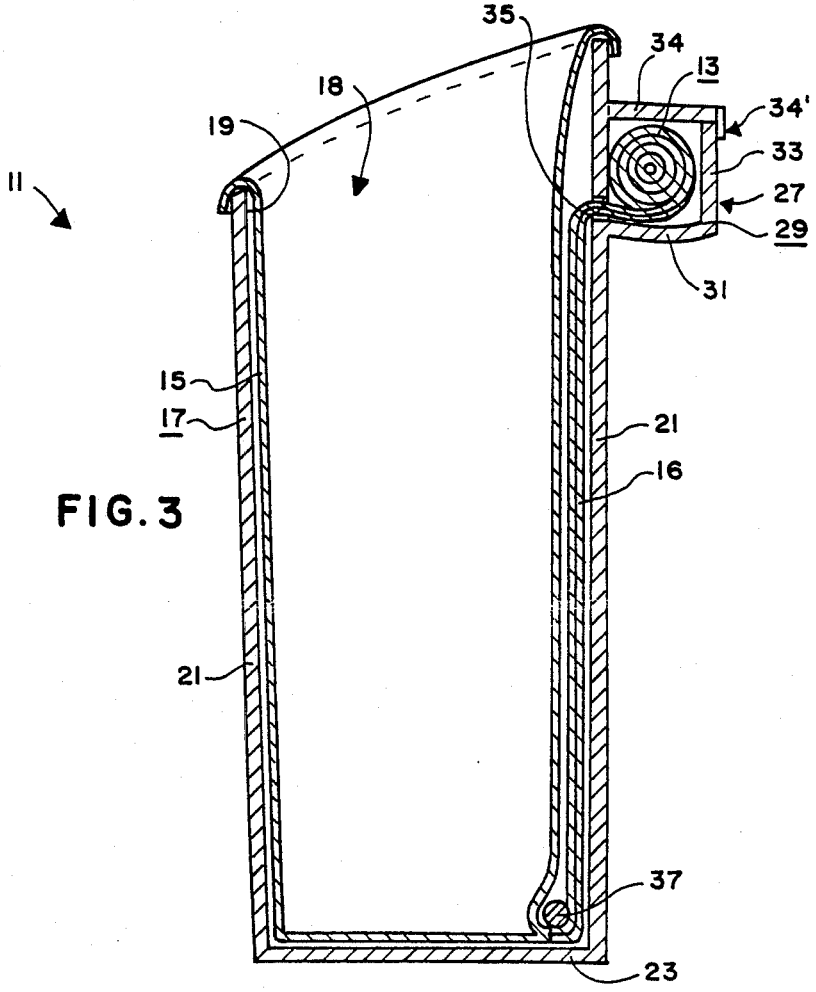
FIG. 3

TRASH CONTAINER

BACKGROUND OF THE INVENTION

1. Field of the Invention

The present invention relates, in general, to a trash container adapted to receive a roll of plastic trash bags.

2. Description of the Related Air

Many different designs and styles of trash containers for use in kitchens and the like have been developed. It is common practice to line such trash containers with plastic trash bags. Such trash bags are often sold in rolls in which a plurality of individual trash bags are joined end-to-end in a manner which allows a single trash bag to be removed from the roll and then inserted through the open mouth of the trash container to line the trash container.

SUMMARY OF THE INVENTION

The present invention is directed toward providing an improved trash container which allows trash bags to be continuously drawn into the interior of the trash container from a roll of such trash bags. The concept of the present invention is to mount a roll of trash bags to a trash container and provide structure which allows individual trash bags to be drawn into the interior of the trash container to line the trash container.

A trash container of the present invention includes a main body compartment having an open interior and having an open mouth communicating with the interior and through which trash may be inserted; and holding means for holding the roll of trash bags adjacent the main body compartment. The main body compartment has a slot therethrough to allow the free end of the roll of trash bags held within the holding means to extend therethrough into the interior of the main body compartment.

BRIEF DESCRIPTION OF THE DRAWINGS

FIG. 1 is a perspective view of the trash container of the present invention as viewed from the rear with a roll of trash bags combined therewith.

FIG. 2 is a perspective view of a roll of trash bags.

FIG. 3 is a sectional view through the trash container of the present invention with a roll of trash bags associated therewith and with the lid of the trash container removed for clarity.

DESCRIPTION OF THE PREFERRED EMBODIMENT

The preferred embodiment of the trash container 11 is for use in combination with a roll 13 of trash bags. The roll 13 of trash bags includes a plurality of individual trash bags attached end-to-end to one another in a manner which allows a single trash bag to be removed from the periphery of the roll 13 as will now be apparent to those skilled in the art. Thus, the roll 13 of trash bags includes a first trash bag 15 with the open mouth of the first trash bag 15 defining the free end of the roll 13, a second trash bag 16 with the mouth of the second trash bag 16 attached to the closed end of the first trash bag 15 in any manner now apparent to those skilled in the art, a third trash bag with the mouth of the third trash bag attached to the closed end of the second trash bag 16, etc. The individual trash bags may be constructed out of plastic in any manner now apparent to those skilled in the art.

The trash container 11 includes a main body compartment 17 having an open interior 18 and having an open mouth 19 communicating with the interior 18 and through which trash and the like may be inserted. The main body compartment 17 may be formed by a substantially cylindrical or tubular wall member 21 and a bottom member 23 extending across and closing the lower end of the wall member 21. The cross-sectional shape of the main body compartment 17 may be various specific shapes such as circular, rectangular, etc., as defined by the wall member 21.

The trash container 11 preferably includes a lid 25 for selectively closing the open mouth 19 of the main body compartment 17. The lid 25 may be hinged or otherwise movably attached to the upper end of the wall member 21 of the main body compartment 17, as will now be apparent to those skilled in the art, to allow trash to be placed into and removed from the interior 18 of the main body compartment 17.

The trash container 11 includes holding means 27 for holding the roll 13 of trash bags adjacent the main body compartment 17. The holding means 27 may be of various specific constructions. The holding means 27 preferably includes a box-like structure 29 attached to the wall member 21 of the main body compartment 17 at the rear thereof. The front wall member 21 of the main body compartment 29 is preferably designed so as to off-set the weight of the combined roll 13 of trash bags and holding means 27. Thus, the front wall member 21 of the main body compartment 17 may be angled outward and upward so as to increase the weight thereof especially when trash or the like is introduced into the interior thereof to act as a counter weight for the roll 13 of trash bags and the holding means 27 as will now be apparent to those skilled in the art. The box-like structure 29 is sized so as to receive the roll 13 of trash bags as clearly shown in FIGS. 1 and 3. While the structure of the box-like structure 29 may vary, it preferably includes a bottom member 31 attached to and extending outwardly from the wall member 21 and a wall member 33 extending upwardly from the bottom member 31 and attached at either end to the wall member 21 as shown in FIGS. 1 and 3. The bottom member 31 is preferably curved or rounded to correspond with the curvature of the roll 13 of trash bags. A lid 34 is preferably provided to cover the open top of the box-like structure 29. The lid 34 is preferably hinged to the wall member 21 and a snap-type lock 34' or the like is preferably provided to secure the lid 34 in a closed position as will now be apparent to those skilled in the art.

The main body compartment 17 has a slot 35 through the wall member 21 directly above the bottom member 31 to allow the free end of the roll 13 of trash bags held within the holding means 27 to extend therethrough into the interior 18 of the main body compartment 17 as clearly shown in FIG. 3.

The trash container 11 preferably includes an arm member 37 extending across the interior 18 of the main body compartment 17 directly above the bottom member 23 to allow the free end of the roll 13 of trash bags to be threaded thereunder as shown in FIG. 3 and for causing the individual trash bags to be held adjacent the bottom member 23 as will now be apparent to those skilled in the art.

The trash container 11 may be constructed in various specific manners. Thus, the main body compartment 17, lid 25, box-like structure 29, and lid 34 may be molded or otherwise constructed out of plastic in any manner now apparent to those skilled in the art, and the arm member 37 may consist of a metal rod or the like extending completely through the main body compartment 17.

The operation of the trash container 11 is quite simple. The first step is to insert the mouth end of the first trash bag 15 of the roll 13 of trash bags through the slot 35 into the interior 18 of the main body compartment 17 and place the remainder of the roll 13 in the box-like structure 29. Next, from the interior 18 of the main body compartment 17, the mouth end of the first trash bag 15 of the roll 13 of trash bags is threaded under the arm member 37. If the trash bags are folded when in the roll 13 as is typical and as shown in FIG. 2, the trash bags are unfolded at the arm member 37 and the mouth end of the first trash bag 15 is pulled to the top of the main body compartment 17 and secured thereto by, for example, being folded thereover in a typical manner. Trash can then be inserted into the first trash bag 15 lining the main body compartment 17. When the first trash bag 15 is filled, the open mouth thereof is merely tied or otherwise closed and the filled first trash bag 15 is lifted out of the interior 18 of the main body compartment 17, pulling the mouth of the second trash bag 16 on the roll 13 to the top of the main body compartment 17 in a manner as well now be apparent to those skilled in the art. The bottom of the filled first trash bag 15 is then separated from the mouth of the second trash bag 16 in the typical manner now apparent to those skilled in the art. Once the second trash bag 16 is filled, the above procedure is repeated to pull the mouth of a third trash bag to the top of the main body compartment 17, and so on until all the trash bags of the roll 13 have been filled at which time a new roll 13 of trash bags is inserted in the manner described above.

Although the present invention has been described and illustrated with respect to a preferred embodiment and a preferred use therefor, it is not to be so limited since modifications and changes can be made therein which are within the full intended scope of the invention.

I claim:

1. A trash container for use in combination with a roll of trash bags having a free end, said trash container comprising:

(a) a main body compartment having an open interior and having an open mouth communicating with said interior and through which trash may be inserted;

(b) holding means for holding said roll of trash bags adjacent said main body compartment;

(c) said main body compartment having a slot therethrough to allow said free end of said roll of trash bags held within said holding means to extend therethrough into said interior of said main body compartment; said main body compartment including a wall member and a bottom member extending across and closing the lower end of said wall member; and (d) an arm member extending across said interior of said main body compartment directly above said bottom member to allow said free end of said roll of trash bags to be threaded thereunder and for causing said individual trash bags to be held adjacent said bottom member.

2. The trash container of claim 1 in which said arm member includes a rod extending completely through said main body compartment.

3. A trash container comprising, in combination:

(a) a main body compartment having an open interior and having an open mouth communicating with said interior and through which trash may be inserted; said main body compartment including a wall member and a bottom member extending across and closing said lower end of said wall member;

(b) a roll of trash bags, said roll of trash bags includes a plurality of individual trash bags attached end-to-end to one another in a manner which allows a single trash bag to be removed from the periphery of said roll;

(c) holding means for holding said roll of trash bags adjacent said main body compartment;

(d) said main body compartment having a slot therethrough to allow said free end of said roll of trash bags held within said holding means to extend therethrough into said interior of said main body compartment; and (e) an arm member extending across said interior of said main body compartment directly above said bottom member to allow said free end of said roll of trash bags to be threaded thereunder and for causing said individual trash bags to be held adjacent said bottom member.

* * * * *